US010919605B2

(12) United States Patent
Adams

(10) Patent No.: US 10,919,605 B2
(45) Date of Patent: Feb. 16, 2021

(54) ANTI-TWIST FRAME, VESSEL AND METHOD FOR LOWERING AN OBJECT IN A WATER BODY

(71) Applicant: JUMBO MARITIME B.V., Schiedam (NL)

(72) Inventor: Cornelis Gerardus Nicolaas Adams, Schiedam (NL)

(73) Assignee: JUMBO MARITIME B.V. [NL/NL]

( * ) Notice: Subject to any disclaimer, the term of this patent is extended or adjusted under 35 U.S.C. 154(b) by 180 days.

(21) Appl. No.: 16/304,522

(22) PCT Filed: May 23, 2017

(86) PCT No.: PCT/NL2017/050324
§ 371 (c)(1),
(2) Date: Nov. 26, 2018

(87) PCT Pub. No.: WO2017/204630
PCT Pub. Date: Nov. 30, 2017

(65) Prior Publication Data

US 2019/0217927 A1 Jul. 18, 2019

(30) Foreign Application Priority Data

May 25, 2016 (NL) ..... 2016832

(51) Int. Cl.
*B63B 27/10* (2006.01)
*B66C 23/52* (2006.01)
(Continued)

(52) U.S. Cl.
CPC ..... *B63B 27/10* (2013.01); *B63B 27/16* (2013.01); *B66C 1/10* (2013.01); *B66C 1/62* (2013.01);
(Continued)

(58) Field of Classification Search
CPC combination set(s) only.
See application file for complete search history.

(56) References Cited

U.S. PATENT DOCUMENTS 9,073,733 B2 * 7/2015 Blaxland ..... B66C 13/08
2011/0094987 A1 * 4/2011 Botwright ..... B66C 23/185 212/274
2011/0221215 A1 * 9/2011 Botwright ..... B66C 23/36 294/81.4

FOREIGN PATENT DOCUMENTS

CN 104692247 A 6/2015
GB 1184999 A * 3/1970 ..... B66C 1/101
(Continued)

OTHER PUBLICATIONS

International Search Report for International Application No. PCT/NL2017/050324 dated Sep. 12, 2017.

*Primary Examiner* — Kyle Armstrong
(74) *Attorney, Agent, or Firm* — Suiter Swantz pc llo

(57) ABSTRACT

The invention relates to a method for lowering an object in a water body from a vessel floating on the water body, the vessel comprising first hoisting means with second hoisting means arranged on or near the vessel, with at least a first anti-twist frame (ATF) being connected to a lower end of a first hoisting cable of the first hoisting means, the object being attached to the lower end of the first hoisting cable, below the ATF. The method allows for adjusting the vessel's heading prior to carrying out the method, allowing the vessel to remain substantially aligned with the wind/wave direction, and at the same time preventing the first hoisting cable from being subjected to excessive twist.

9 Claims, 8 Drawing Sheets

(51) Int. Cl.

| | |
|---|---|
| ***B66C 13/08*** | (2006.01) |
| ***B66C 1/62*** | (2006.01) |
| ***B63B 27/16*** | (2006.01) |
| ***B66C 1/10*** | (2006.01) |
| ***B66C 13/06*** | (2006.01) |

(52) U.S. Cl.
CPC ..... *B66C 13/06* (2013.01); *B66C 13/08* (2013.01); *B66C 23/52* (2013.01); *B63B 2027/165* (2013.01)

(56) References Cited

FOREIGN PATENT DOCUMENTS

| | | | | | |
|---|---|---|---|---|---|
| GB | 1302245 | A | * | 1/1973 | ..... B66C 1/102 |
| WO | 2012/151631 | A1 | | 11/2012 | |

* cited by examiner

ANTI-TWIST FRAME, VESSEL AND METHOD FOR LOWERING AN OBJECT IN A WATER BODY

FIELD OF THE INVENTION

The present invention relates to a method for lowering an object in a water body. The present invention also relates to a vessel for carrying out such a method and an anti-twist frame (ATF) for use with such a method.

BACKGROUND OF THE INVENTION

In the prior art, methods are known for underwater installation of structures. A disadvantage of these methods is that especially for deep water purposes the hoisting cable used for the underwater installation may rotate/twist about a vertically oriented axis, thereby damaging the hoisting cable due to excessive twist.

The British patent publication GB 2,519,997 A addresses the related problem of "cabling", which is a phenomenon wherein imbalanced torsional characteristics of two cables, being used in 2-fall or parallel operation to lower or raise a load, can result in the cables axially rotating, causing the effective cable separation to decrease, and possibly resulting in rotational entanglement of the two cables employed. This can occur both in single cable hoist systems used in 2-fall configuration, as well as in parallel winch operations using cables of opposite hand lay.

In U.S. Pat. Nos. 6,588,985 and 6,771,563, an apparatus comprising underwater propulsion means has been proposed for deploying an object or a load, being coupled to a hoist, on the seabed from a vessel and position them at an underwater installation site without the use of guide wires. The apparatus further comprises a main module, provided with drive means such as thrusters, and a second or counter module. The specific positioning of the thrusters of the main module and of the counter module provide, at opposite sides of the lifting wire, a counter-torque that can be exerted at the hoist wire in both directions. In this way, the object can be accurately positioned on the seabed. However, the problem of lifting wire twist is mentioned but not satisfactorily solved.

Furthermore, from practice, anti-twist methods are known wherein on each side of the crane block anti-twist beams are arranged. However, a problem with such a system is that it can only be used for a single vessel heading.

An object of the invention is thus to provide a method for lowering an object in a water body, wherein the method can be employed in a wide range of wind/wave/swell directions and twist of the hoisting cable is minimized.

SUMMARY OF THE INVENTION

Hereto, the invention provides a method for lowering an object in a water body from a vessel floating on the water body, the vessel comprising first hoisting means, and second hoisting means arranged on or near the vessel, with at least a first anti-twist frame (ATF) being connected to a lower end of a first hoisting cable of the first hoisting means, the object being attached to the lower end of the first hoisting cable, below the ATF, comprising the steps of:

a) adjusting the vessel's heading such that the vessel is substantially aligned with the wind/wave/swell direction, b) lowering the object in the water body with the first hoisting means until the object has reached a first depth (FD);

c) using the second hoisting means to lower the object together with the first hoisting means as found in step b), or else, to lower a clump weight in the water body to the first depth (FD), wherein the object or the clump weight is connected to the lower end of the second hoisting cable, d) providing an anti-twist wire extending between the first ATF and the second hoisting cable, the first ATF comprising a circumferential part with connection means arranged for connecting the anti-twist wire at a plurality of connection points on the circumferential part, in a plurality of directions, and selecting such a connection point that, after connection, twist of the first hoisting cable is minimized, and e) using the first and/or second hoisting means to lower the object onto the bottom of the water body.

The method advantageously allows the vessel's heading to be substantially aligned with the wind/wave/swell direction prior to the lowering operation, by proper selection of the connection point of the anti-twist wire on the ATF and the second hoisting cable (which could also be provided with a second ATF) and by selecting matching positions of the first and second hoisting means during arrangement of the anti-twist wire, such that during lowering twist of the first hoisting cable is minimized. The inventor has found that in practice the method can be carried out for a vessel heading range of 360° (i.e. omnidirectional). This is unheard of in the industry.

In the context of this patent application a 'vessel' is to be understood as a structure capable of floating on water, such as a barge, a motorized ship, et cetera. However, the method could also be used with structures fixed with respect to (or in) the water body.

The method could further comprise, when a clump weight is used: arranging an orientation wire between the lower ends of the first and second hoisting cables, near the object and the clump weight to create an anti-twist framework.

Preferably, the ATF comprises a central part for attachment to a crane block and the circumferential part is connected to the central part and extending in a plane perpendicular to the respective hoisting cable. When a horseshoe-shaped part is used, the open side of the horseshoe-shaped part points towards the respective hoisting means, such as a crane on a vessel.

The first and/or second hoisting means preferably comprise a crane and the central part of the ATF is arranged for attachment to a crane block of the crane. The crane (boom) must be rotatable in a horizontal plane as well as a vertical plane, such that the ideal crane radius and heading can be achieved.

In an embodiment, a second anti-twist frame (ATF) is connected to a crane block arranged near a lower end of the second hoisting cable of the second hoisting means and the anti-twist wire extends between the first ATF and the second ATF, wherein the connection points of the anti-twist wire on the first ATF and the second ATF are so chosen, that, after connection, twist of the first and second hoisting cables is minimized. Thus, effectively, a double ATF configuration is provided.

In an embodiment of the aforementioned method, multiple connection means, such as pad-eyes, are arranged at multiple positions along the circumference of the circumferential part to allow the longitudinal direction of the anti-twist wire to intersect the longitudinal direction of the respective hoisting cable for a plurality of anti-twist wire directions. These multiple connection means allow the anti-twist wire to be arranged relative to one or both ATF's in an optimal way.

Preferably, the connection means (and preferably the directions associated therewith) are spaced-apart along the circumference at a mutual spacing angle of 20-30°. Such a spacing provides a large degree of flexibility for connecting the anti-twist wire to the ATF's. In practice, a closer spacing appears not necessary, whereas a larger spacing limits the options for providing an optimal connection between the ATF's.

Preferably, the at least one anti-twist wire and the at least one orientation wire are substantially parallel for ease of connection and for having a maximally effective anti-twist framework. Advantageously, the use of multiple wires allows for creating a more reliable frame-like structure. 'Parallel' is to be broadly understood as the one wire having a directional component extending parallel to the directional component of the other wire in the hoisting plane. For instance, crossing (X) wires or slightly converging/diverging wires also comply with the above definition of 'parallel'.

The clump weight is preferably arranged at the first depth (FD) in such a way that the anti-twist wire is brought under tension, in particular by the sheer weight of the clump weight.

Preferably, the method further comprises monitoring (or carrying out) at least one of the steps b)-e) with a subsea vehicle. Advantageously, no divers are required then.

More preferably, the subsea vehicle is a remotely operated vehicle (ROV). Such an ROV can both monitor the steps, as well as be involved in performing these steps (when provided with a robotic arm or the like).

Advantageously, the first depth (FD) is 25-75 m, preferably about 50 m, under the waterline (WL). Thus, the risk of something going wrong during the critical steps of lowering the object from the waterline (WL) to the first depth (FD) and arrangement of the anti-twist wire is relatively low due to proximity to the waterline.

Another aspect of the invention concerns a vessel for use with the aforementioned method, comprising first and second hoisting means arranged on a deck of the vessel, at one side of the vessel, a first and a second anti-twist frame (ATF) and an anti-twist wire for arrangement between the first and second ATF or the first ATF and the second hoisting cable, wherein the first and/or second ATF comprise a circumferential part with connection means arranged for connecting the anti-twist wire at a plurality of connection points on the circumferential part, in a plurality of directions.

Yet another aspect of the invention relates to an anti-twist frame (ATF) for use with the aforementioned method, comprising a circumferential part with connection means arranged for connecting the anti-twist wire at a plurality of connection points on the circumferential part, in a plurality of directions, such as at least two, three, four, five, six, seven, eight, nine, ten, eleven, twelve, or more (horizontal) directions.

An embodiment relates to an ATF comprising a central part for attachment to the crane block, wherein the circumferential part is connected to the central part and extends in a plane perpendicular to the respective hoisting cable, during use.

A further embodiment relates to an aforementioned ATF, wherein multiple connection means, such as pad-eyes, are arranged at multiple positions along the circumference of the circumferential part to allow the longitudinal direction of the anti-twist wire to intersect the longitudinal direction of the respective hoisting cable for a plurality of anti-twist wire directions.

Preferably, the connection means are spaced-apart along the circumference at a mutual spacing angle of 20-30°.

BRIEF DESCRIPTION OF THE DRAWINGS

The invention will be explained in more detail below with reference to drawings in which illustrative embodiments thereof are shown. They are intended exclusively for illustrative purposes and not to restrict the inventive concept, which is defined by the appended claims.

DETAILED DESCRIPTION OF EMBODIMENTS

Figure 1:
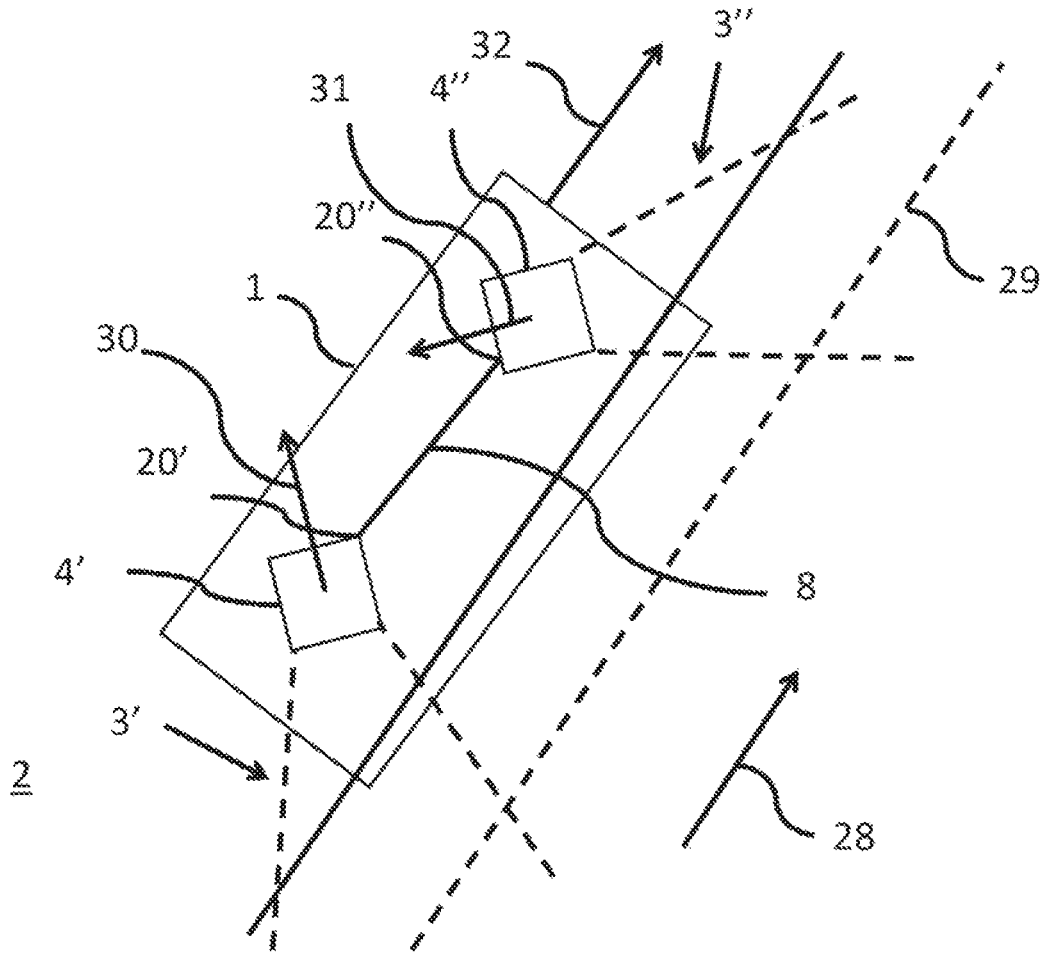
FIG. 1 shows a top view of a vessel at the destination for installing the object during step c) of the method.

FIG. 1 shows a top view of a vessel at a destination position for installing an object 1 on the bottom of the water body 2, in this case the seabed 26. During the aforementioned step a) as shown, the vessel's heading 29 can be adjusted such that the vessel is substantially aligned with the wind/wave direction 28. During step c) the connection point 20', 20" of the anti-twist wire 8 on each of the individual ATF's 4', 4" and the rotational positions/directions 30, 31 of the first and second hoisting means 3', 3" are so chosen, that twist of the first and second hoisting cables is minimized. The only limitations that are present concern limits on the amount of acceptable pre-twist and a limit to the rotational ability of the hoisting means 3', 3" (i.e. during the lowering operation the hoisting means 3, 3" can not be rotated so far as to collide with the vessel's side). Although a configuration is shown with two ATF's, according to the invention, a single ATF is sufficient to provide the stated benefits.

Figure 2:
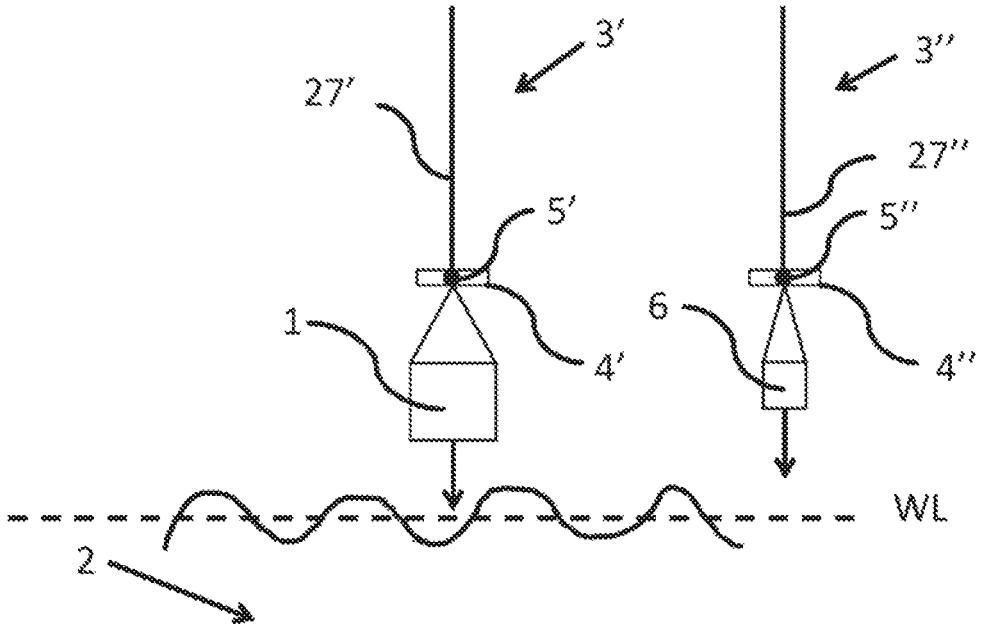
FIG. 2 shows a schematic view of a submerging step of a method for lowering an object in a water body in accordance with an embodiment of the invention.

FIG. 2 shows a schematic view of a submerging step of a method for lowering an object 1 in a water body 2 using first and second hoisting means 3', 3", such as a crane with a hoisting wire, provided with respectively a first and a second anti-twist frame 4', 4". The first and a second anti-twist frame 4', 4" are provided at a lower end 5', 5" of a respective hoisting cable 27', 27". The water body 2 can for example be a sea, ocean or any other kind of water volume. The second hoisting means 3" could also comprise a winch or the like.

The first hoisting means 3' is arranged for lowering the object 1 below the waterline WL into the water body 2. The second hoisting means 3" is arranged for lowering a clump weight 6, shown in FIG. 3, below the waterline WL into the water body 2. The lower ends 5', 5" are arranged for receiving the first and a second anti-twist frame 4', 4". Furthermore, the lower ends 5', 5" are arranged for releasable connection with the object 1 and the clump weight 6. The first and the second anti-twist frame 4', 4" are arranged for preventing twist of respectively the first and second hoisting means 3', 3". Alternatively, the second hoisting means 3" can also be connected to (another part of) the object 1 (as shown in FIG. 3*b*) or just be provided with the clump weight 6, without an ATF.

In a submerging step of the aforementioned method for lowering an object 1 in a water body 2 using the hoisting means 3',3", the object 1 is releasably connected to the lower end 5' of the first hoisting means 3'. Then the object 1 is lowered below the waterline WL into the water body 2 until the object 1 has basically reached a first depth FD.

Figure 3:
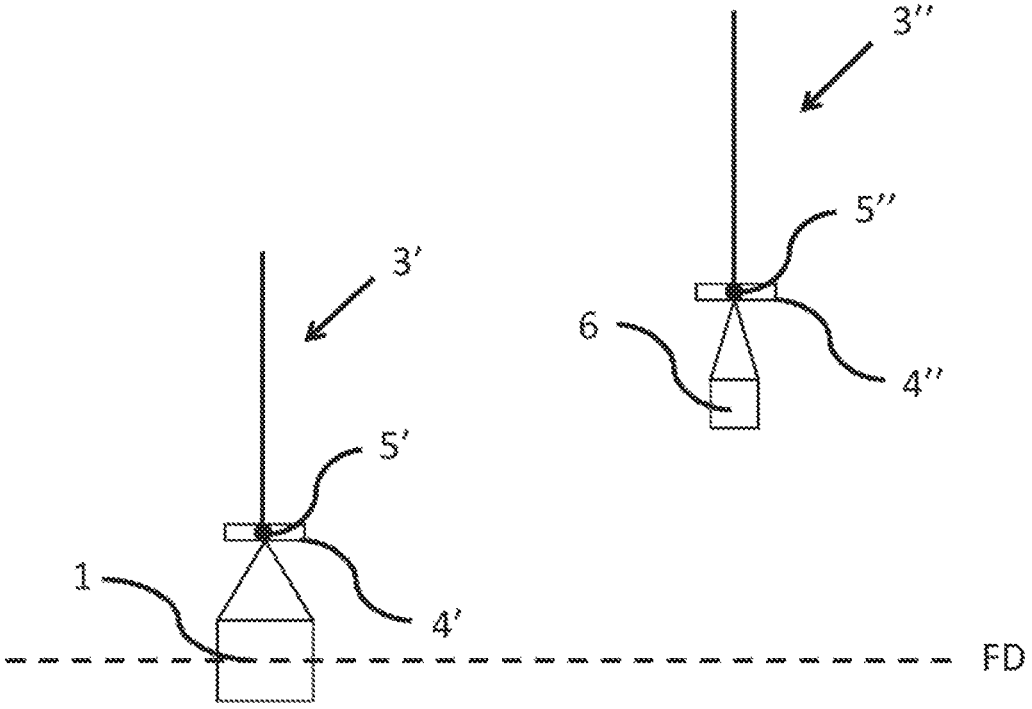
FIG. 3 shows a schematic view of a lowering step of the method of FIG. 2 in accordance with an embodiment of the invention.

FIG. 3 shows a schematic view of a first lowering step of the method of FIG. 2 in accordance with an embodiment of the invention. In a second step of the method, a clump weight 6 is releasably connected to the lower end 5" of the second hoisting means 3" (i.e. the second hoisting cable 27"). The clump weight 6 is introduced in the water body 1 and lowered via the second hoisting means 3" to substantially the first depth FD. At the first depth FD, a hoisting plane is defined by the longitudinal directions of the first and second hoisting means 3',3".

Figure 4A:
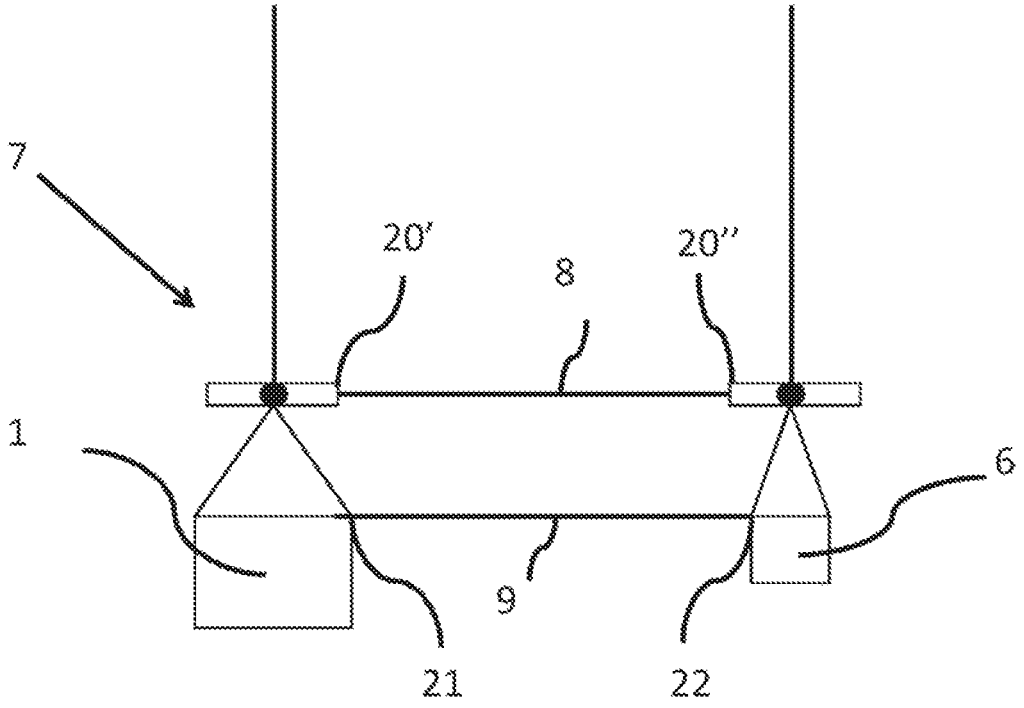
FIG. 4*a* shows a schematic view of an underwater anti-twist framework with a clump weight.
Figure 4B:
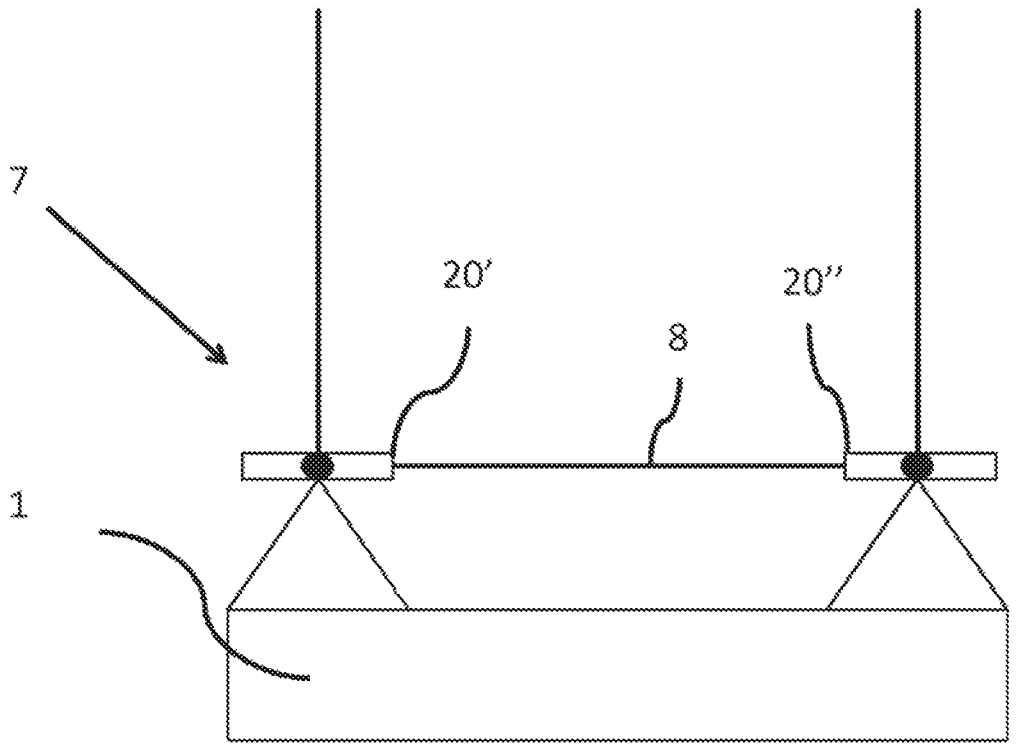
FIG. 4*b* shows a schematic view of an underwater anti-twist framework with the second hoisting means connected to a further part of the object.

FIG. 4*a* shows a variant of an underwater anti-twist framework 7 created with the method according to the invention. The underwater anti-twist framework 7 is created in the hoisting plane by releasably connecting an anti-twist wire 8 to connection points 20', 20". Analogously, an orientation wire 9 is arranged between the object 1 and the clump weight 6. The connection points 20', 20", 21, 22 are therefore located on the first and second hoisting means 3', 3" in the vicinity of respectively the object 1 and the clump weight 6. When the second hoisting means 3" is connected to (another part of) the object 1, the orientation wire 9 can of course be omitted. This variant is shown in FIG. 4*b*.

Furthermore, it is possible to use alternative configurations with connection points in the hoisting plane for creating the framework 7. And, as stated before, the second ATF can in principle be omitted.

Figure 5:
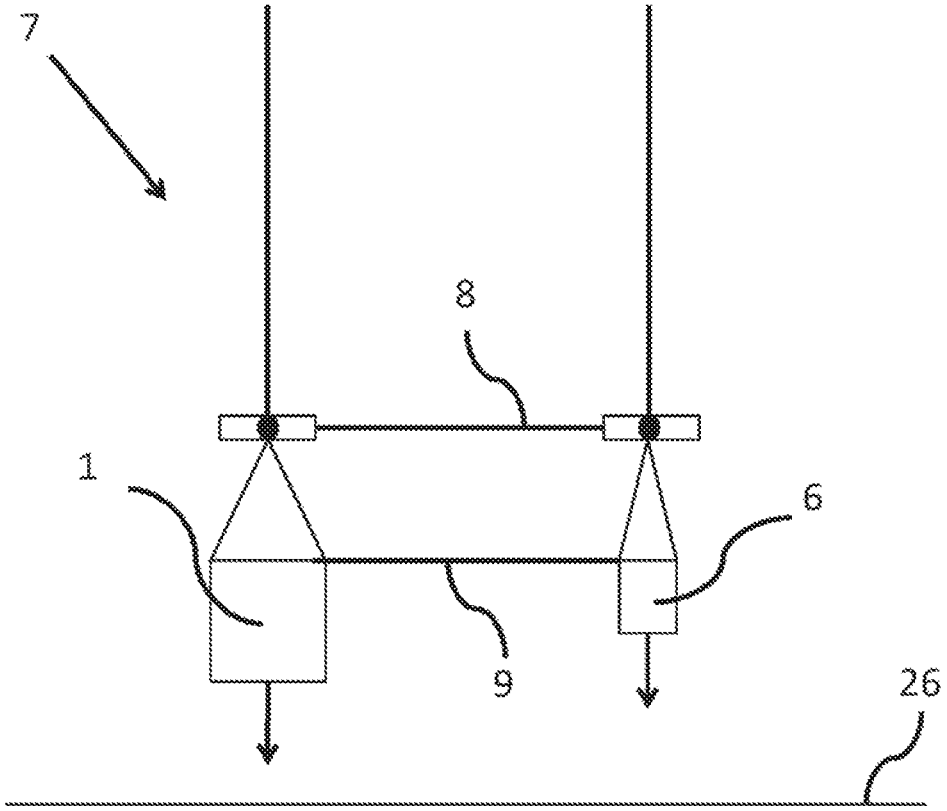
FIG. 5 shows a schematic view of a lowering step of the method of FIG. 2 in accordance with an embodiment of the invention.

FIG. 5 shows a schematic view of a second lowering step of the method of FIG. 1. The object 1 is lowered onto the seabed 26, Preferably, the clump weight 6 does not touch the seabed 26 during this last lowering action.

Figure 6:
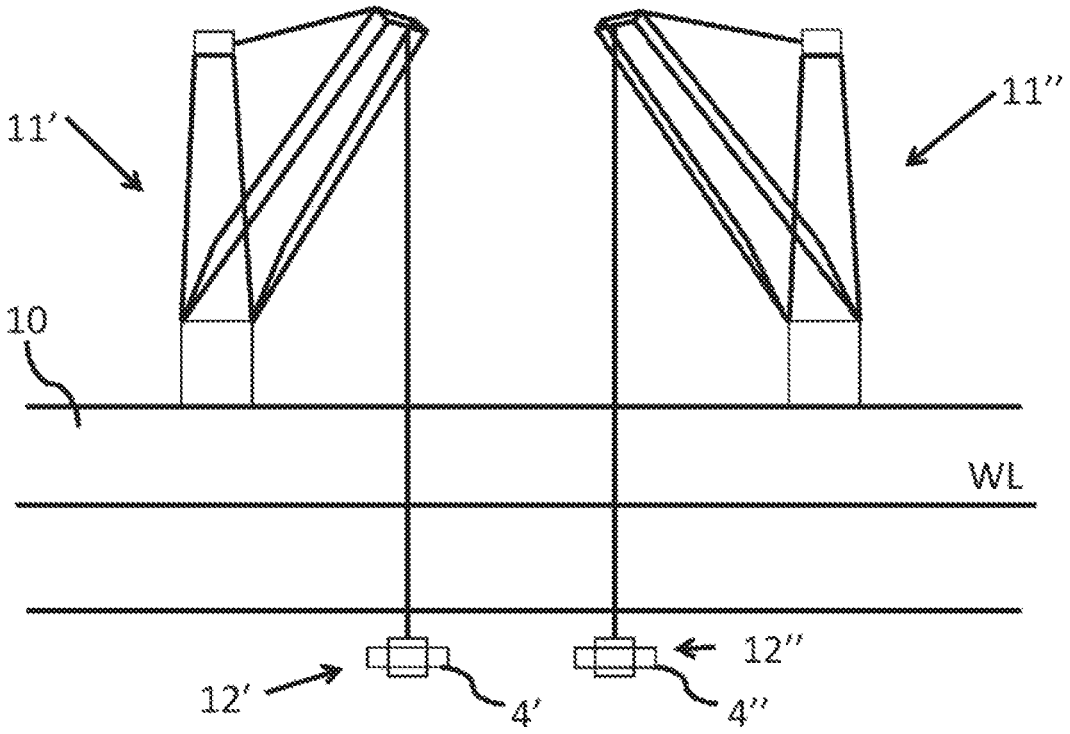
FIG. 6 shows a schematic front view of a dual anti-twist crane structure in accordance with an embodiment of the invention.

FIG. 6 shows a schematic view of a dual anti-twist crane structure for lowering an object 1 in a water body 2. The dual anti-twist crane structure comprises at least one support structure 10 (such as the deck or hull of a vessel). The at least one support structure 10 is arranged for supporting a first and second crane 11',11". The first and second cranes are arranged for lowering loads, such as the object 1, in the water body 2.

In an embodiment of the invention, the first and second crane 11',11" can be supported by respectively a first and a second structure of the at least one support structures 10. Each crane 11',11" comprises a crane block 12',12" which, during use, is provided with respectively a first and a second anti-twist frame 4', 4".

During operation the first and second cranes 11',11" are arranged in such a manner that the water body is in working range of the first and second crane 11',11". Moreover, the destination position in the water body 2 also needs to be within working range of the first and second crane 11',11".

Figure 7:
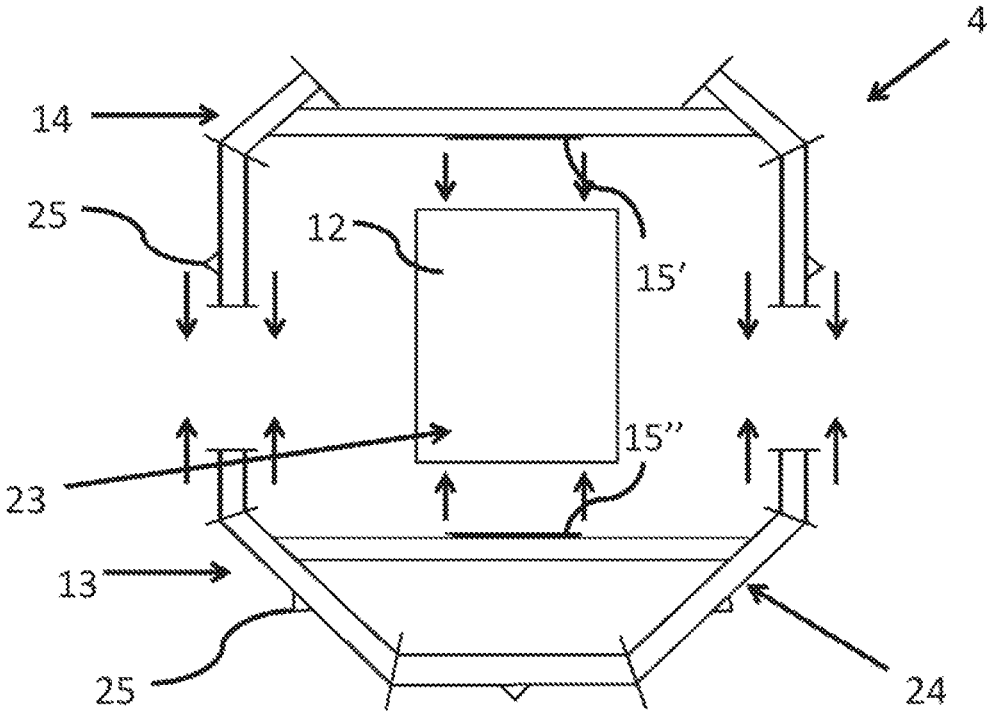
FIG. 7 shows a schematic top view of an anti-twist frame in accordance with an embodiment of the invention.

FIG. 7 shows a schematic view of an embodiment of an anti-twist frame 4, for instance for attachment to a crane block 12 of a crane. The anti-twist frame 4 comprises a front and a back frame part 13, 14, with the back frame part 14 directed towards the crane during use. The front and the back frame part 13, 14 are interconnectable. Each frame part 13,14 comprises a connection plate 15',15". The connection plates 15',15" are arranged for attaching respectively the front frame part 13 and back frame part 14 to the crane block 12. Essentially, the anti-twist frame comprising a central part 23 for attachment to the crane block 12 and a circumferential part 24 to which the anti-twist wire 8 is to be connected. Thereto, the circumferential part 24 is provided with multiple connection means 25 arranged at regularly-spaced intervals on the outside of the circumferential part 24, such that the orientation of the anti-twist frame 4 can be adapted accurately and connection of the anti-twist wire 8 is facilitated. The anti-twist frame as shown has a circumferential part 24 in the shape of a truncated octagon (when viewed from above), preferably a truncated regular octagon. The truncation is present at a back side of the anti-twist frame. The intervals may enclose a (horizontal) angle of for instance 30-60°, preferably 20-30°, relative to the centerline of the first hoisting cable. According to the invention, the connection means 25 are arranged for connecting the anti-twist wire 8 at a plurality of connection points 20', 20" on the circumferential part 24, over an angular range, in a horizontal plane, during use, of at least 45°, 90° or 180°, such as at least 190°, 200°, 210°, 220°, 230°, 240°, 250°, 260°, but more preferably at least 270°, such as at least 280°, 290°, 300°, 310°, 320°, 330°, 340°, 350°, or even 360° (omnidirectional), and selecting such a connection point that, after connection, twist of the hoisting cable(s) is minimized.

More preferably, the connection means 25 comprise padeye anti-twist wire connections arranged for connection of an anti-twist wire to prevent twist of the anti-twist frame 4.

Other alternatives and equivalent embodiments of the present invention are conceivable within the idea of the invention, as will be clear to the person skilled in the art. The scope of the invention is limited only by the appended claims.

LIST OF REFERENCE SIGNS

1. Object
2. Water body
3'. First hoisting means
3". Second hoisting means
4. Anti-twist frame
4'. Anti-twist frame of the first hoisting means
4". Anti-twist frame of the second hoisting means
5'. Lower end of the first hoisting means
5". Lower end of the second hoisting means
6. Clump weight
7. Anti-twist framework
8. Anti-twist wire
9. Orientation wire
10. Support structure
11'. First crane
11". Second crane
12. Crane block
12'. First crane block
12". Second crane block
13. Front frame part
14. Back frame part
15'. Front connection plate
15". Back connection plate
20'. Connection point of the first hoisting means
20". Connection point of the second hoisting means
21. Connection point of the object
22. Connection point of the clump weight
23. Central part
24. Circumferential part
25. Connection means
26. Seabed

27'. First cable
27". Second cable
28. Wind/wave direction
29. Vessel longitudinal axis (vessel's heading)
30. Rotational direction of first hoisting means
31. Rotational direction of second hoisting means
32. Object heading
WL. Waterline
FD. First depth
S. Symmetry axis

The invention claimed is:

1. A method for lowering an object in a water body from a vessel floating on the water body, the vessel comprising a first hoisting means and a second hoisting means, the first hoisting means and the second hoisting means arranged on or near the vessel, with at least a first anti-twist frame (ATF) being connected to a lower end of a first hoisting cable of the first hoisting means, the object being attached to the lower end of the first hoisting cable, below the ATF, comprising the steps of:

a) adjusting the vessel's heading such that the vessel is aligned with the wave direction, b) lowering the object in the water body with the first hoisting means until the object has reached a first depth (FD);

c) using the second hoisting means to lower the object together with the first hoisting means as found in step b), wherein the second hoisting means is connected to another part of the object, or else, to lower a clump weight in the water body to the first depth (FD), wherein the clump weight is connected to the lower end of the second hoisting cable, d) providing an anti-twist wire extending between the first ATF and the second hoisting cable, the first ATF comprising a circumferential part with a plurality of connection means arranged for connecting the anti-twist wire at a plurality of connection points on the circumferential part, in a plurality of directions, and selecting such a connection point that, after connection, twist of the first hoisting cable is minimized, and the first ATF comprising a central part for attachment to a crane block, wherein the circumferential part is connected to the central part and extends in a plane perpendicular to the respective hoisting cable, during use, wherein the plurality of connection means are arranged at multiple positions along the circumference of the circumferential part to allow the longitudinal direction of the anti-twist wire to intersect the longitudinal direction of the respective hoisting cable for a plurality of anti-twist wire directions, and wherein the plurality of connection means are spaced-apart along the circumference, and e) using the first and/or the second hoisting means to lower the object onto the bottom of the water body.

2. The method according to claim 1, wherein a second anti-twist frame (ATF) is connected to a crane block arranged near a lower end of the second hoisting cable of the second hoisting means and the anti-twist wire extends between the first ATF and the second ATF, wherein the connection points of the anti-twist wire on the first ATF and the second ATF are so chosen, that, after connection, twist of the first and second hoisting cables is minimized.

3. The method according to claim 1, wherein the plurality of connection means are spaced-apart along the circumference at a mutual spacing angle of 20-30°.

4. The method according to claim 1, wherein the method further comprises monitoring at least one of the steps b)-e) with a subsea vehicle.

5. The method according to claim 4, wherein the subsea vehicle is a remotely operated vehicle (ROV).

6. The method according to claim 1, wherein the first depth (FD) is 25-75 m under the waterline (WL).

7. A vessel for use with a method according to claim 1, comprising a first hoisting means and a second hoisting means arranged on a deck of the vessel, at one side of the vessel, a first and/or a second anti-twist frame (ATF) and an anti-twist wire for arrangement between the first and second ATF or the first ATF and the second hoisting cable, wherein the first and/or second ATF comprise a circumferential part with a plurality of connection means arranged for connecting the anti-twist wire at a plurality of connection points on the circumferential part, in a plurality of directions, and the first ATF and/or the second ATF comprising a central part for attachment to a crane block, wherein the circumferential part is connected to the central part and extends in a plane perpendicular to the respective hoisting cable, during use, wherein the plurality of connection means are arranged at multiple positions along the circumference of the circumferential part to allow the longitudinal direction of the anti-twist wire to intersect the longitudinal direction of the respective hoisting cable for a plurality of anti-twist wire directions, and wherein the plurality of connection means are spaced-apart along the circumference.

8. An anti-twist frame (ATF) for use with the method according to claim 1, comprising a circumferential part with a plurality of connection means arranged for connecting the anti-twist wire at a plurality of connection points on the circumferential part, in a plurality of directions, and the ATF comprising a central part for attachment to the crane block, wherein the circumferential part is connected to the central part and extends in a plane perpendicular to the respective hoisting cable, during use, wherein the plurality of connection means are arranged at multiple positions along the circumference of the circumferential part to allow the longitudinal direction of the anti-twist wire to intersect the longitudinal direction of the respective hoisting cable for a plurality of anti-twist wire directions, and wherein the plurality of connection means are spaced-apart along the circumference.

9. The ATF according to claim 8, wherein the plurality of connection means are spaced-apart along the circumference at a mutual spacing angle of 20-30°.

* * * * *